US005323634A

United States Patent [19]

Wolfe et al.

[11] Patent Number: 5,323,634

[45] Date of Patent: Jun. 28, 1994

[54] SHUT HEIGHT ADJUSTMENT DEVICE HAVING REPLACEABLE SPACERS

[75] Inventors: Bruce A. Wolfe, Grantville; James L. Russ, Enola, both of Pa.

[73] Assignee: The Whitaker Corporation, Wilmington, Del.

[21] Appl. No.: 62,098

[22] Filed: May 14, 1993

[51] Int. Cl.[5] ..... B21D 37/04; B21J 13/06

[52] U.S. Cl. ..... 72/446; 72/441; 72/482; 29/753

[58] Field of Search ..... 72/441, 446, 32, 482, 72/419; 29/753

[56] References Cited

U.S. PATENT DOCUMENTS

| | | | |
|---|---|---|---|
| 3,126,045 | 3/1964 | Streit | 72/441 |
| 3,184,950 | 5/1965 | Sitz | 72/419 |
| 3,611,773 | 10/1971 | Gerth | 72/482 |
| 3,911,717 | 10/1975 | Yuda | 29/753 |
| 4,718,160 | 1/1988 | Bulanda et al. | 29/753 |
| 4,790,173 | 12/1988 | Boutcher, Jr. | 72/446 |
| 5,084,960 | 2/1992 | Yeomans | 29/753 |
| 5,095,599 | 3/1992 | Gloe et al. | 29/753 |

*Primary Examiner*—David Jones
*Attorney, Agent, or Firm*—Robert J. Kapalka

[57] ABSTRACT

A shut height adjustment device is provided for a press having press and tooling rams coupled in spaced relationship during a forward stroke of the press ram. The adjustment device includes a carrier defining a rotation axis and a plurality of apertures concentric with the rotation axis. A plurality of spacers are removably held in the plurality of apertures. Each of the spacers extends parallel to the rotation axis between a pair of opposite end surfaces which accurately define a length of each of the spacers. Different ones of the spacers have different lengths. The carrier is rotatably mountable on a post coupled between the press and tooling rams such that the different ones of the spacers may be selectively disposed between the press and tooling rams for engagement by opposed contact portions of the rams during the forward stroke of the press ram. The length of an engaged spacer defines the spaced relationship between the rams, and the spaced relationship is adjustable by engagement of the different ones of the spacers between the contact portions of the rams.

18 Claims, 6 Drawing Sheets

Fig. 3
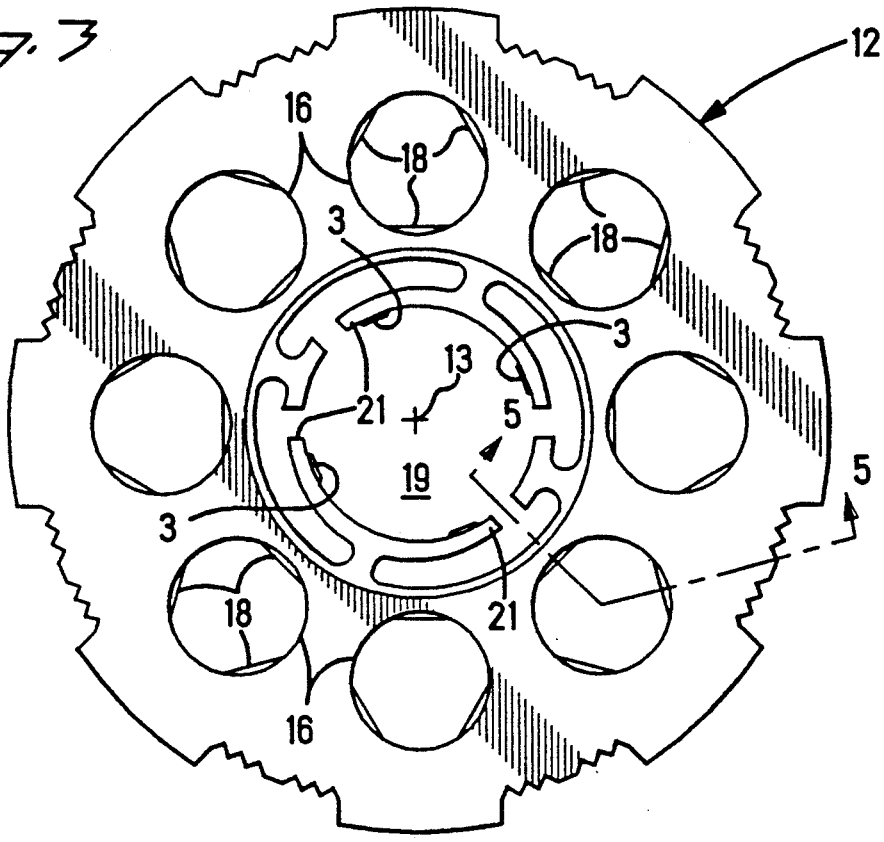
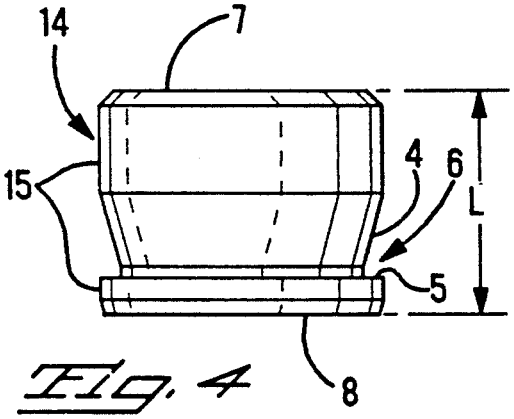
Fig. 4
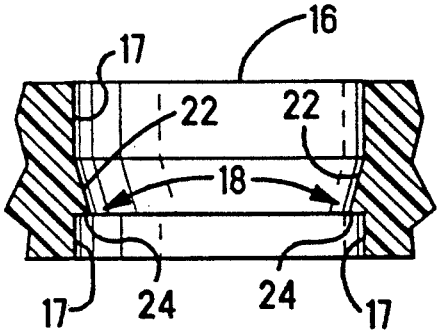
Fig. 5
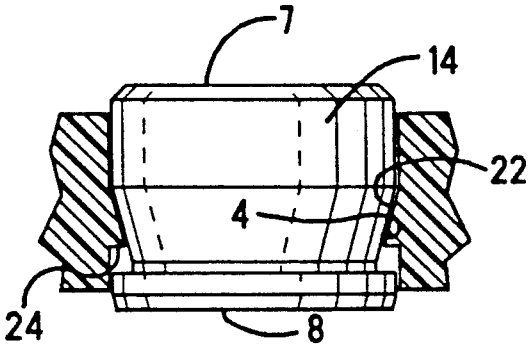
Fig. 6
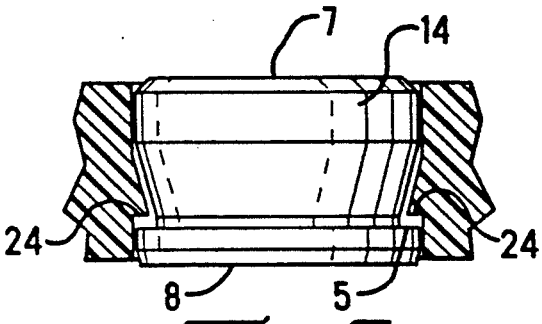
Fig. 7

SHUT HEIGHT ADJUSTMENT DEVICE HAVING REPLACEABLE SPACERS

BACKGROUND OF THE INVENTION

1. Field of the Invention

The invention relates to the field of crimping or other press machines having a ram which is movable into proximity with a base for engaging a workpiece therebetween, and more particularly, to a device for adjusting the closest proximity of the ram with respect to the base in a press machine.

2. Prior Art

Numerous types of press machines are used in industry for performing operations on a workpiece. The press machines typically have a ram which reciprocates toward and away from a base for engaging the workpiece therebetween. One type of press machine is an automatic crimping machine for crimping terminals to electrical conductors.

Various types of terminals may be deformed, or crimped, around electrical conductors to provide an electrical connection therewith. A terminal crimping machine typically comprises a tooling ram carrying a crimping die which reciprocates toward and away from a base of the machine. The crimping die cooperates with an anvil die attached to the base to deform a terminal disposed therebetween when the crimping die is in proximity with the anvil die.

Height of the terminal after deformation is referred to as the crimp height. The crimp height is a valuable indicator of quality of the crimped connection. A crimp height that is too large will not provide a secure and reliable connection, while a crimp height that is too small results in excessive deformation which will weaken or break the terminal and/or conductor, and in addition wastes energy in driving the machine.

The crimp height is a function of shut height of the machine, i.e., a dimension between the crimping die and the anvil die when the crimping die is in its closest proximity with respect to the anvil die. The shut height may need to be changed to accommodate different sizes and types of terminals and/or conductors which require different crimp heights. Also, the shut height may need adjustment to compensate for such things as tooling wear, dimensional tolerances of replacement parts, and dimensional changes due to temperature variations.

Devices for adjusting the shut height of automatic crimping machines are known. U.S. Pat. No. 3,184,950 to Sitz discloses a shut height adjusting device for an automatic crimping machine having a power, or press, ram which drives a tooling ram carrying the crimping die toward the anvil die. The adjusting device comprises a rotary disc interposed between the press and tooling rams. A side of the disc facing the press ram has a plurality of pairs of bosses of different heights. Contact arms of the press ram bear against selected pairs of the bosses during a crimping stroke of the press ram, thereby governing a spaced relationship between the press and tooling rams. The disc is rotatable to selectively position different pairs of the bosses for engagement by the contact arms, thereby changing the spaced relationship between the rams and thus the shut height of the machine. A detent mechanism is provided to ensure that the selected bosses are aligned with the contact arms and are maintained in position until a different selection is made. Although the Sitz device performs adequately, the disc is expensive to manufacture because it is an integral metal unit and the bosses must be machined to close dimensional tolerances. If one of the bosses is machined incorrectly the entire disc may be ruined, and when a boss becomes worn or damaged in use, the entire disc must be replaced with a new disc having bosses machined to correct dimensions. Furthermore, a single disc has only four pairs of bosses which provide four different crimp heights, and a plurality of discs must be stocked to cover a broad range of different crimp heights.

U.S. Pat. No. 4,790,173 to Boutcher, Jr., discloses a shut height adjustment device comprising a mounting block fixed to the press ram and a dial rotatably secured between the mounting block and the tooling ram. Facing surfaces of the mounting block and the dial define opposed helical ramps. A change in angular position of the dial causes the ramps to ride over each other, whereby the dial is axially displaced with respect to the press ram and shut height of the machine is changed. The device of Boutcher, Jr., enables infinite adjustment of crimp height between upper and lower limits. However, the device does not enable a particular crimp height to be quickly and easily selected because the angled ramps do not provide natural zones associated with discretely different crimp heights. Production of a desired crimp height is attainable primarily after making a series of adjustments while zeroing in on the desired crimp height through trial and error.

The present invention overcomes the problems of the prior art shut height adjustment devices by providing a carrier which removably holds a plurality of spacers for selective interposition between the press and tooling rams. The spacers are simple and inexpensive to produce so that a large inventory of the spacers precisely machined to different heights can be stocked. The spacers are easily interchangeable in the carrier so that a large number of discrete crimp heights is obtainable.

SUMMARY OF THE INVENTION

It is an object of the invention to provide a shut height adjustment device for a press that is less expensive than prior art shut height adjustment devices.

It is another object of the invention to provide a shut height adjustment device that is easily alterable to provide a substantial number of different shut heights.

It is yet another object of the invention to provide a shut height adjustment device that is easily repairable by replacement of damaged or worn parts.

These and other objects are accomplished by a shut height adjustment device for use in a press having a press ram movable through fixed forward and return strokes, and a tooling ram coupled to the press ram for movement toward and away from a base during .the forward and return strokes, respectively, the press ram and tooling ram being in spaced relationship at least during the forward stroke. The shut height adjustment device comprises a carrier having a plurality of spacers and means for removably holding the plurality of spacers. Each of the spacers has a pair of opposite end surfaces which accurately define a length thereof, different ones of the spacers having different lengths. At least one of the spacers is engageable between opposed contact portions of the press and tooling rams such that the opposite end surfaces of the at least one spacer are engaged by associated ones of the contact portions during the forward stroke of the press ram, whereby the length of the at least one spacer defines the spaced relationship between the rams. The carrier is alterable to arrange the different ones of the spacers between the contact portions, wherein the spaced relationship between the rams is adjustable.

In accordance with one aspect of the invention, the spacers are made of tool steel or other metal and have a circular cross-section. The carrier is made of plastic and is rotatable on an axis. The spacers are arranged in apertures in the carrier concentric to the axis. The carrier includes means for indexing the carrier at different angles of rotation about the axis to align the different ones of the spacers between the contact portions of the rams. Each of the spacers has a circumferential groove which is interengageable with ridges defined by the walls of the apertures to permit removal and replacement of the spacers in the apertures.

BRIEF DESCRIPTION OF THE DRAWINGS

There are shown in the drawings the embodiments of the invention that are presently preferred. It should be understood, however, that the invention is not limited the precise arrangements and instrumentalities shown in the drawings, wherein:

FIG. 3 is a top view of the carrier.

FIG. 4 is a side view of one spacer.

FIG. 5 is a cross-sectional view of an aperture in the carrier taken along line 5—5 of FIG 3.

FIG. 6 is a cross-sectional view of a spacer having a representative length disposed in the carrier.

FIG. 7 is a cross-sectional view of a spacer having a different length disposed in the carrier.

DETAILED DESCRIPTION OF THE PREFERRED EMBODIMENTS

Figure 1:
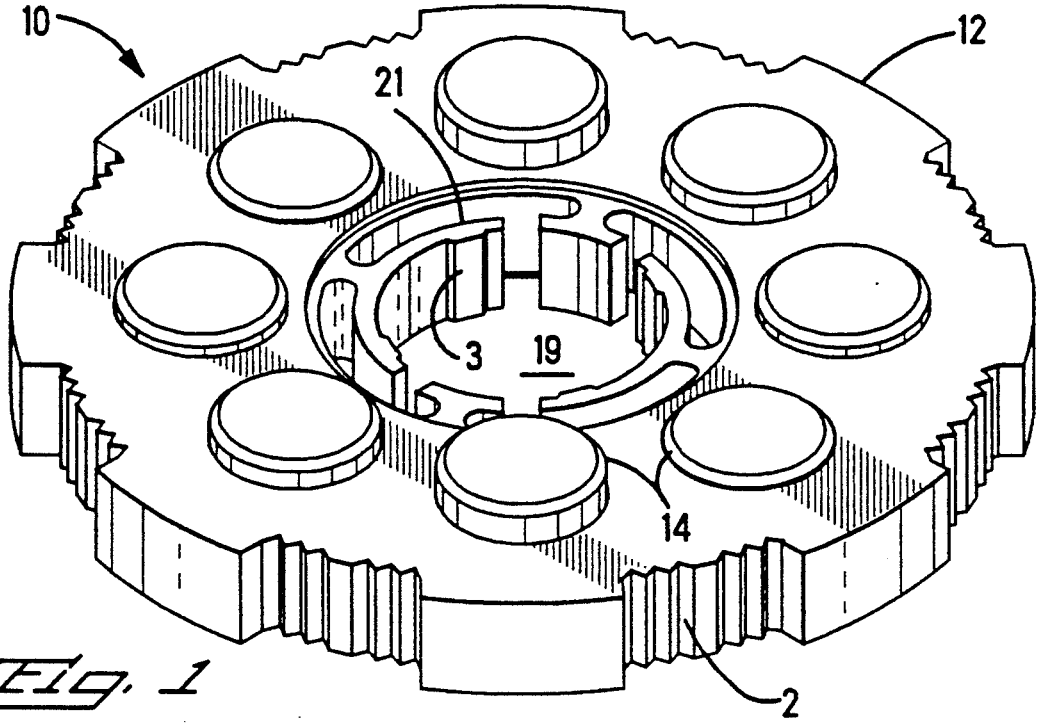
FIG. 1 is a top perspective view of shut height adjustment device according to the invention.
Figure 2:
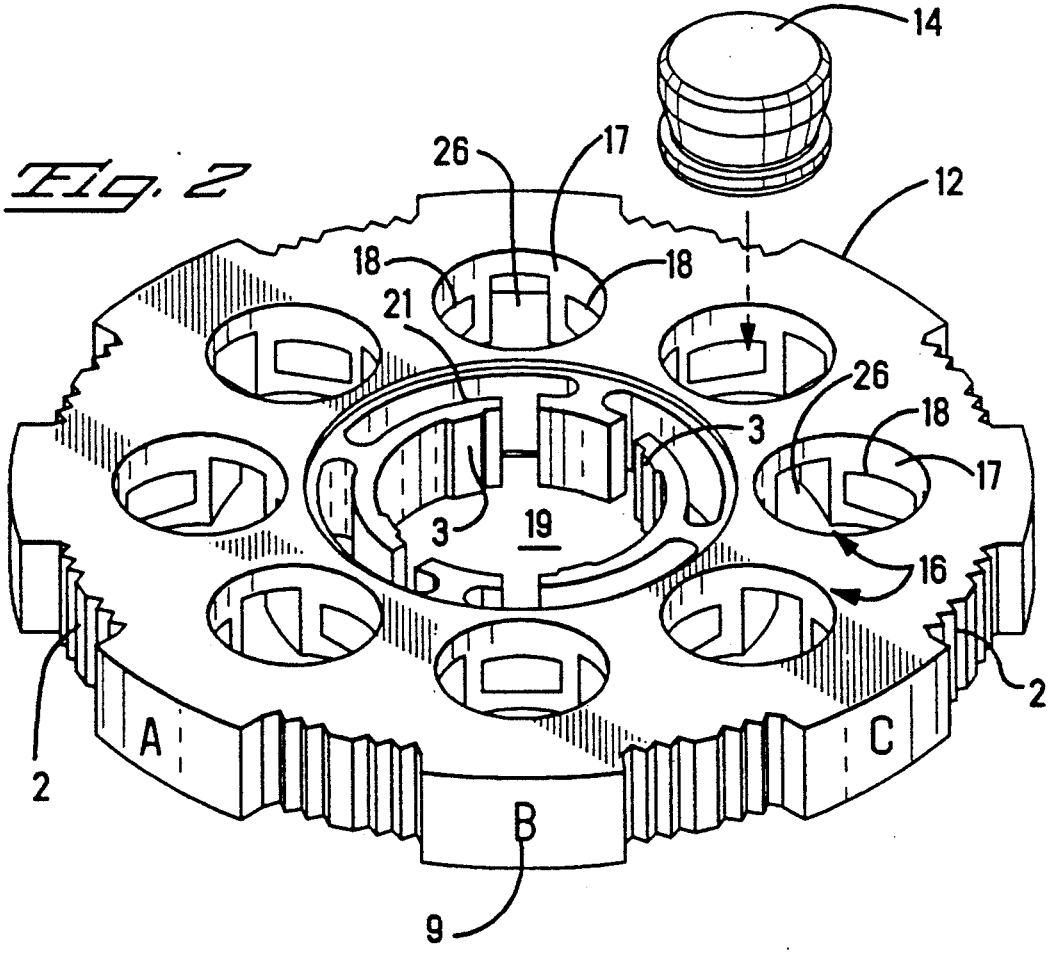
FIG. 2 is a top perspective exploded view of a carrier and one spacer for the shut height adjustment device according to the invention.
Figure 8:
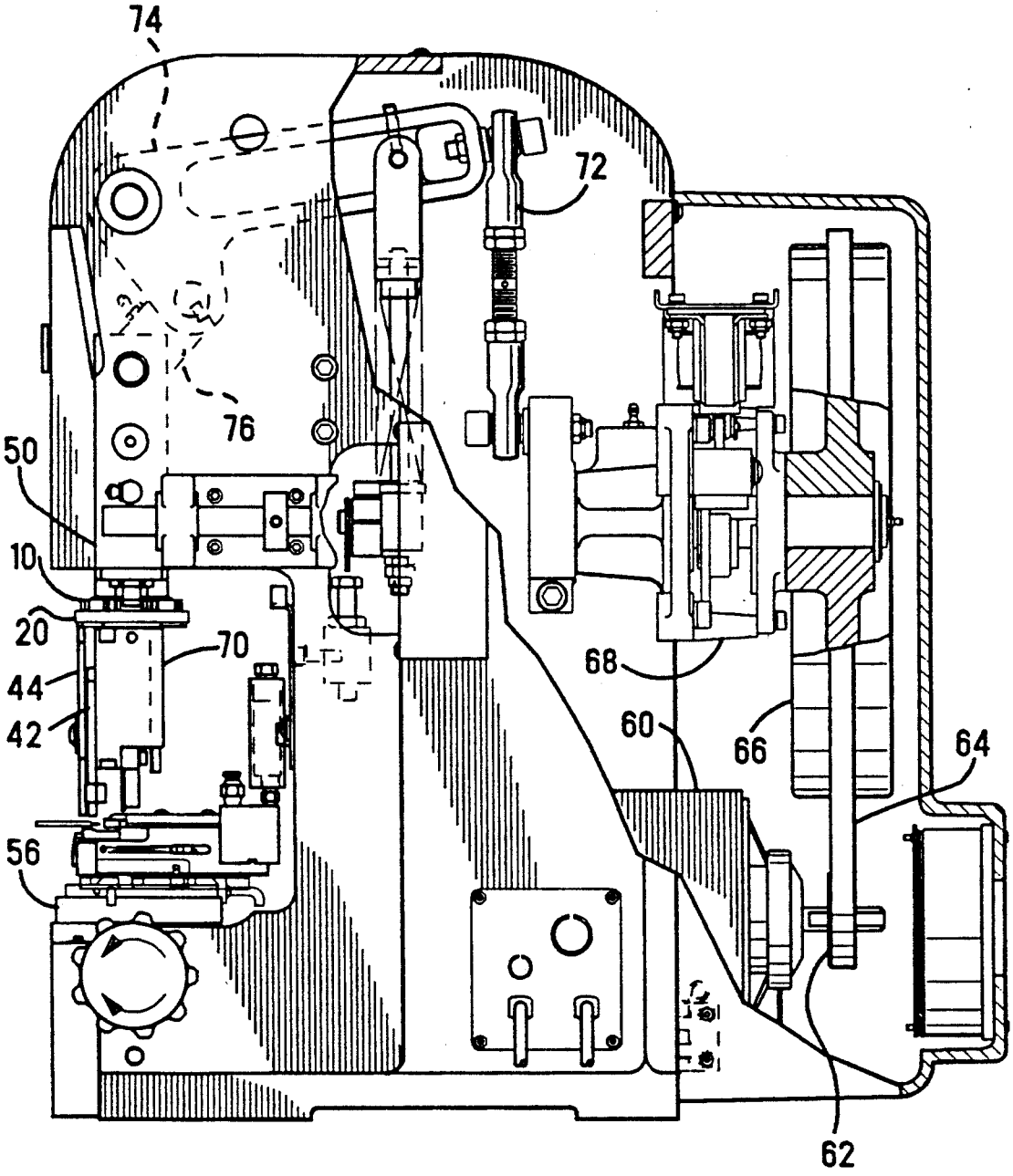
FIG. 8 is a view of the shut height adjustment device installed in a terminal crimping press.

A shut height adjustment device according to the invention is useful in a terminal crimping press such as shown in FIG. 8. The press has a press ram 50 which is movable through forward and return strokes toward and away from a base 56. The press ram 50 is driven through the forward and return strokes by drive means including motor 60 having pulley 62 which is connected by belt 64 to flywheel 66. A single revolution clutch 68 is operable for selectively coupling with the flywheel 66 to reciprocate a connecting rod 72 through a single up and down cycle. Movement of the rod 72 is transferred through pivotal connecting links 74, 76 to the press ram 50, whereby a single revolution of the clutch 68 moves the press ram 50 through single forward and return strokes. It will be understood by those skilled in the art that the shut height adjustment device according to the invention can be used with alternative types of presses.

Figure 9:
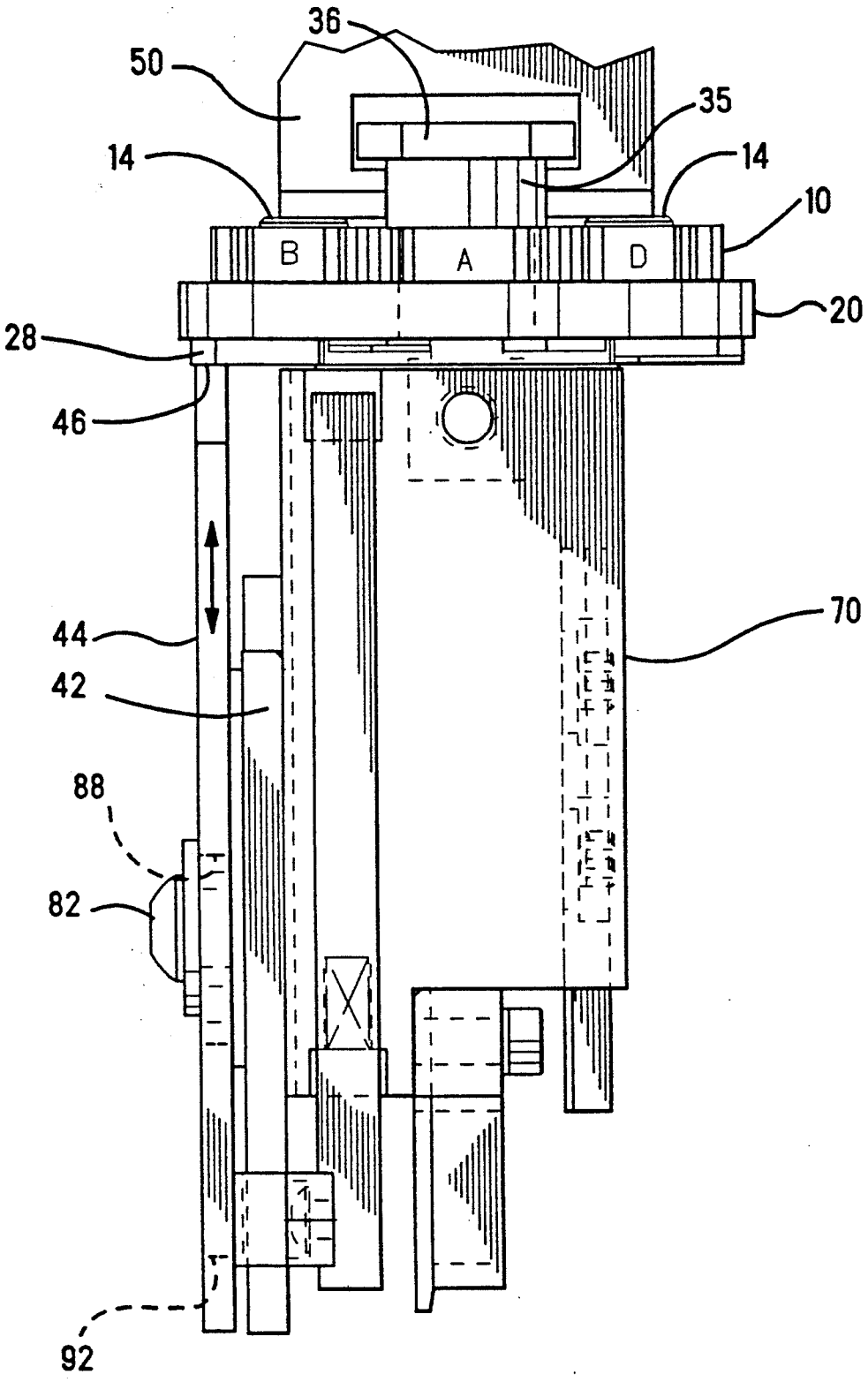
FIG. 9 is an enlarged view of the shut height adjustment device and associated tooling of the press of FIG. 8.
Figure 10:
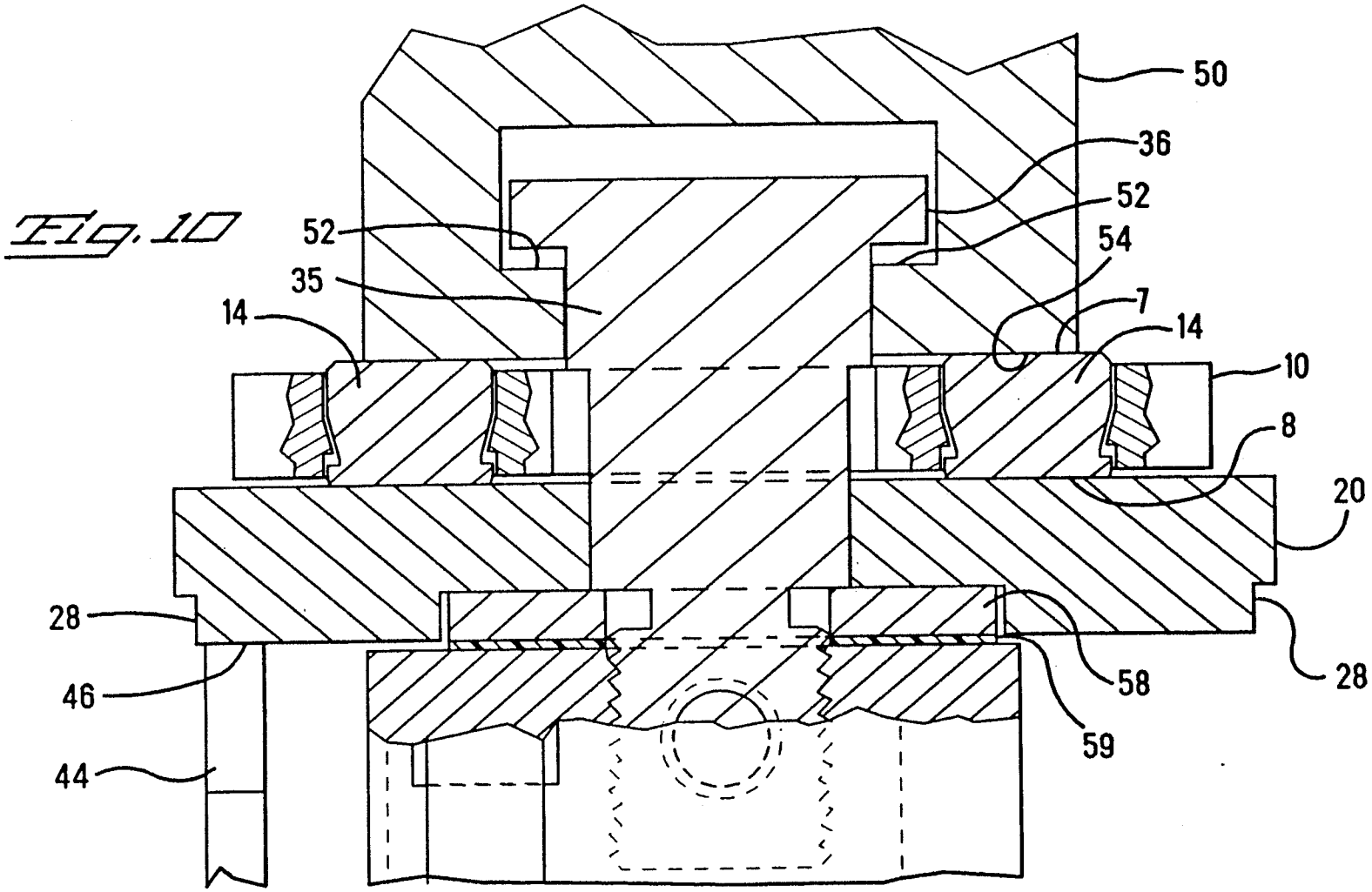
FIG. 10 is a partial cross-sectional view of the shut height adjustment device and associated tooling of FIG. 9.
Figure 11:
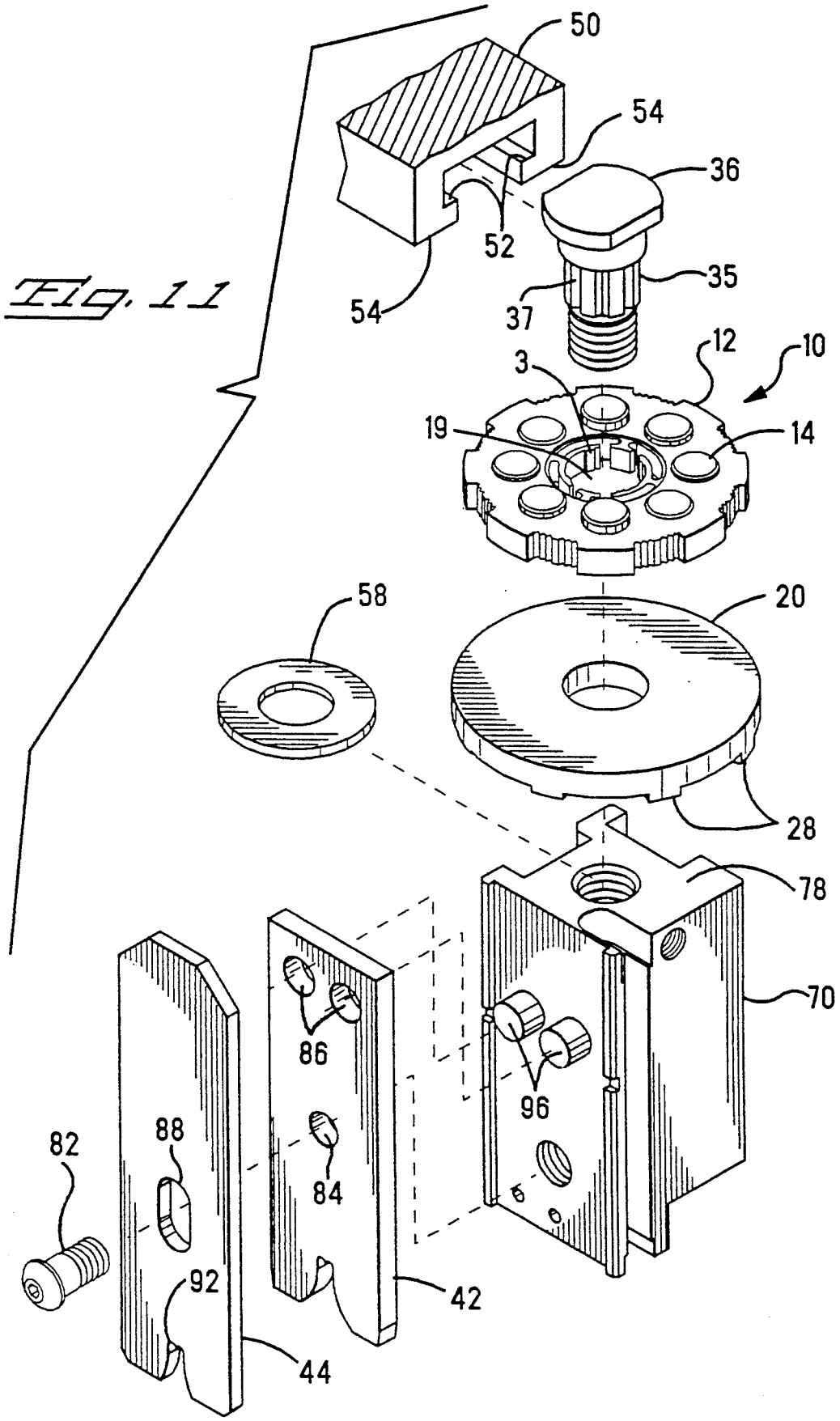
FIG. 11 is an exploded perspective view of the shut height adjustment device and associated tooling.

A tooling ram 70 is coupled to the press ram 50 for movement toward and away from the base 56 during the forward and return strokes, respectively. As shown more clearly in FIGS. 9–11, a post 35 having an enlarged head 36 is threadedly engaged with the tooling ram 70. The enlarged head 36 is slidably received between hook-like ends 52 of the press ram 50, thereby permitting the tooling ram 70 to be changed. Wire crimper 42 and insulation crimper 44 are carried by the tooling ram 70. The wire crimper 42 has holes 86 which receive locating dowels 96 extending from the tooling ram 70. The insulation crimper 44 has a slot 88 which receives threaded fastener 82 therethrough to permit limited sliding movement of the insulation crimper 44 with respect to the tooling ram 70. The fastener 82 extends through cavity 84 in the wire crimper 42 and is engaged in the tooling ram 70.

Shut height adjustment device 10 of the present invention is rotatably mounted on the post 35 between the press ram 50 and the tooling ram 70. As shown in FIGS. 1–5, the shut height adjustment device 10 comprises a carrier 12 having a central bore 19 which receives the post 35 therethrough. The carrier 12 has means for removably holding a plurality of spacers 14. In a preferred embodiment as shown in the drawings, the means for removably holding comprises a plurality of apertures 16 which are arranged concentric with a rotation axis 13 defined by the central bore 19 of the carrier 12. Each of the apertures 16 has a generally cylindrical wall 17 which extends through opposite end faces of the carrier 12. As shown in detail in FIG. 5, the wall 17 is interrupted by three equiangularly spaced ridges 18, each of the ridges 18 being defined by an angled ramp 22 and a perpendicular ledge 24. The ridges 18 are disposed on a circumference of the cylindrical wall 17 at an intermediate location along an axial length of the wall. The carrier 12 is preferably molded of a plastic material which is substantially rigid but has a some compliancy for enabling removal of the spacers 14 as hereinafter described. The carrier 12 may be molded with vents 26 in the walls 17 of the apertures 16 to increase the compliancy of the walls.

A representative one of the spacers 14 is shown in detail in FIG. 4. The spacer 14 has a generally cylindrical periphery 15 and is dimensioned for slidable insertion within the cylindrical wall 17 of any one of the apertures 16. The cylindrical periphery of the spacer 14 is interrupted by an angled portion 4 and a perpendicular seat 5 which cooperate to define a circumferential groove 6. The spacer 14 has a pair of opposite end surfaces 7, 8 which accurately define a length L of the spacer. The spacers 14 are machined from tool steel or other hard material, and different ones of the spacers 14 are machined accurately and with close tolerances to different lengths L, the lengths L always being greater than the axial length of the apertures 16 in the carrier 12. The groove 6 is preferably disposed at an intermediate location along the length L corresponding to the intermediate location of the ridges 18 along the axial length of the apertures 16 such that the opposite end surfaces 7, 8 are disposed outwardly of external surfaces of the carrier.

FIGS. 6 and 7 illustrate two of the spacers 14 having different lengths L disposed in the apertures 16 of the carrier 12. In the Figs., differences-in the length L have been exaggerated for clarity. In use, the carrier 12 normally holds four pairs of the spacers 14 in diametrically opposite pairs of the apertures 16, each of the pairs of spacers having the same length L and differing from the other pairs by 0.0005 inch in length.

The spacers 14 are removably retained in the apertures 16 by interengagement of the ridges 18 with the groove 6. When the shut height adjustment device 10 is held in one's hands, the spacers 14 can be forcibly removed from within the apertures 16 by exerting finger force upon the end surface 7, whereby the angled portion 4 bears against the ramp 22 and the ridges 18 are deflected radially outwardly due to compliance of the carrier 12, thereby releasing the spacer 14 in one axial direction from the aperture 16. The spacer 14 is secured against removal in the other axial direction by engagement of the perpendicular seat 5 against the perpendicular ledge 24 of the ridge 18.

Referring again to FIGS. 9-11, an underside of the press ram 50 defines a pair of contact portions 54 below the hook-like ends 52. The shut height adjustment device 10 is rotatably mounted on the post 35 such that diametrically opposite pairs of the spacers 14 are selectively movable to positions beneath the pair of contact portions 54, whereby the ends 7 of the selected pair of spacers 14 are engaged by the contact portions 54 during a forward stroke of the press ram 50. An upper side of the tooling ram 70 defines contact portion 78 which is suitable to engage the ends 8 of the selected pair of spacers 14 when the invention is used for adjusting shut height of a generic press. However, the invention is particularly useful for adjusting crimp height of a terminal crimped on a wire in a terminal crimping machine. As illustrated in the drawings, the terminal crimping machine includes an insulation crimping disc 20, a ram washer 58 and a laminated washer 59 interposed between the crimp height adjustment device 10 and the tooling ram 70. The insulation crimping disc 20 includes a plurality of bosses 28 having different heights on a lower surface of the disc. The disc 20 is rotatable to selectively position different ones of the bosses 28 above a top surface 46 of the insulation crimper 44. As the press ram 50 strokes downwardly during a crimping operation on an insulated wire, insulation crimping die 92 contacts insulation on the wire, thereby causing the insulation crimper 44 to ride upwardly on the fastener 82 in the slot 88 until the top surface 46 engages the selected boss 28. The insulation crimping disc 20 thus controls the insulation crimp height relative to the terminal crimp height which is controlled by the adjustment device 10. It will be apparent to those skilled in the art that the adjustment device of the present invention could also be utilized as a replacement for the insulation crimping disc 20.

During a forward stroke of the press ram 50, a selected pair of the spacers 14 having the same length L are engaged between the contact portions 54 of the press ram 50 and the contact portion 78 of the tooling ram 70 having the washers 58 and 59 thereon. Thus, the length L of the selected pair of spacers defines a spaced relationship between the rams 50 and 70, at least during the forward stroke. The spaced relationship between the rams 50 and 70 is adjustable by rotating the adjustment device 10 to arrange a different pair of the spacers 14 having a different length L between the contact portions 54 and 78.

The adjustment device 10 preferably includes means for indexing the carrier 12 at different angular orientations about the post 35 to align the different pairs of the spacers 14 with the contact portions 54. As shown in FIGS. 1-3 and 11, the means for indexing includes the carrier having a plurality of resilient cantilever arms 21 defining a plurality of projections 3 which cooperate with a series of indentations 37 on the post 35 to maintain the carrier 12 at a selected angular orientation. An outer periphery of the carrier 12 includes serrated portions 2 which provide a frictional surface grippable by an operator to rotate the carrier 12 in opposition to bias provided by the means for indexing. Indicia 9 corresponding to different crimp heights are also provided on the outer periphery of the carrier 12.

A shut height adjustment device having replaceable spacers according to the invention provides several advantages over the prior art adjustment devices which are machined from an integral piece of material. The prior art devices are expensive to produce because of the extensive machining required on each unit. The present invention is cheaper to produce because the carrier is a molded piece of plastic material. The invention is easily repairable by simple replacement of worn or damaged spacers, thereby avoiding costly replacement of an entire assembly under most conditions of normal wear and tear. Since the spacers are machined as individual components, a spacer that is inadvertently machined shorter than its intended length during manufacture will usually be useful as a spacer of a different length. Finally, the invention enables an operator having an inventory of the spacers to produce a complete range of crimp heights, whereas the prior art required the operator to have an inventory of expensive discs.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A shut height adjustment device for a press having a press ram movable through fixed forward and return strokes, and a tooling ram coupled to the press ram for movement toward and away from a base during the forward and return strokes, respectively, the press ram and tooling ram being in spaced relationship at least during the forward stroke, the shut height adjustment device comprising:

a carrier having a plurality of spacers and means for removably holding the plurality of spacers, each of the spacers having a pair of opposite end surfaces which accurately define a length of said each spacer, different ones of the spacers having different lengths, at least one of the spacers being engageable between opposed contact portions of the press and tooling rams such that the opposite end surfaces of the at least one spacer are engaged by the contact portions during the forward stroke of the press ram, whereby the length of the at least one spacer defines the spaced relationship between the rams., the carrier being alterable to arrange the different ones of the spacers between the contact portions, wherein the spaced relationship between the rams is adjustable.

2. The shut height adjustment device according to claim 1, wherein the carrier is rotatable on an axis.

3. The shut height adjustment device according to claim 2, wherein the spacers are arranged in the carrier concentric to the axis.

4. The shut height adjustment device according to claim 3, wherein diametrically opposite pairs of the spacers have a-same length and are engageable between a pair of the opposed contact portions.

5. The shut height adjustment device according to claim 3, further comprising means for indexing the carrier at different angular orientations about the axis to align the different ones of the spacers between the contact portions.

6. The shut height adjustment device according to claim 5, wherein the means for indexing includes the carrier having resilient cantilever arms defining projections which cooperate with indentations on a post coupled between the press and tooling rams.

7. The shut height adjustment device according to claim 1, wherein the spacers have a circular cross-section.

8. The shut height adjustment device according to claim 1, wherein the spacers are disposed in apertures defined by the carrier.

9. The shut height adjustment device according to claim 8, wherein the means for removably holding comprises the spacers and walls of the apertures defining interengageable ridges and grooves.

10. The shut height adjustment device according to claim 8, wherein the opposite end surfaces of the spacers are disposed outwardly of external surfaces of the carrier.

11. A shut height adjustment device for a press having a press ram movable through fixed forward and return strokes, and a tooling ram coupled to the press ram for movement toward and away from a base during the forward and return strokes, respectively, the press ram and tooling ram being in spaced relationship at least during the forward stroke, the shut height adjustment device comprising:

a carrier defining a rotation axis and a plurality of apertures concentric with the rotation axis; and, a plurality of spacers removably held in the plurality of apertures, each of the spacers extending parallel to the rotation axis between a pair of opposite end surfaces of said each spacer which accurately define a length of said each spacer, different ones of the spacers having different lengths;

wherein the carrier is rotatably mountable on a post coupled between the press and tooling rams such that the different ones of the spacers may be selectively disposed between the press and tooling rams for engagement by opposed contact portions thereof during the forward stroke of the press ram, whereby t-he length of an engaged spacer defines the spaced relationship between the rams, and the spaced relationship is adjustable by engagement of the different ones of the spacers.

12. The shut height adjustment device according to claim 11, wherein diametrically opposite pairs of the spacers have a same length and are engageable between a pair of the opposed contact portions.

13. The shut height adjustment device according to claim 11, further comprising means for indexing the carrier at different angular orientations about the rotation axis to align the different ones of the spacers between the contact portions.

14. The shut height adjustment device according to claim 11, wherein the means for indexing includes the carrier having resilient cantilever arms defining projections which cooperate with indentations on the post.

15. The shut height adjustment device according to claim 11, wherein the spacers have a circular cross-section.

16. The shut height adjustment device according to claim 11, wherein the spacers and walls of the apertures define interengageable ridges and grooves for removably holding the spacers in the apertures.

17. The shut height adjustment device according to claim 11, wherein the opposite end surfaces of the spacers are disposed outwardly of external surfaces of the carrier.

18. The shut height adjustment device according to claim 11, wherein the carrier is made of a plastic material.

* * * * *